US008037664B2

(12) United States Patent
Squarzoni et al.

(10) Patent No.: US 8,037,664 B2
(45) Date of Patent: Oct. 18, 2011

(54) WRAPPING METHOD AND UNIT FOR FOLDING A SHEET OF WRAPPING MATERIAL ABOUT A GROUP OF CIGARETTES

(75) Inventors: Michele Squarzoni, Ferrara (IT); Stefano Serafini, Crevalcore (IT); Paolo Degliesposti, Bologna (IT); Andrea Biondi, Bologna (IT)

(73) Assignee: G.D Societa' per Azioni, Bologna (IT)

( * ) Notice: Subject to any disclaimer, the term of this patent is extended or adjusted under 35 U.S.C. 154(b) by 182 days.

(21) Appl. No.: 12/468,888

(22) Filed: May 20, 2009

(65) Prior Publication Data

US 2009/0288371 A1 Nov. 26, 2009

(30) Foreign Application Priority Data

May 26, 2008 (IT) ..... BO2008A0327

(51) Int. Cl.
*B65B 11/00* (2006.01)

(52) U.S. Cl. ..... 53/466; 53/477; 53/234; 53/228

(58) Field of Classification Search ..... 53/466, 53/463, 477, 234, 374.6, 465, 225, 228
See application file for complete search history.

(56) References Cited

U.S. PATENT DOCUMENTS

| | | | | |
|---|---|---|---|---|
| 3,426,503 | A * | 2/1969 | Sherrill | 53/529 |
| 3,481,098 | A * | 12/1969 | Sherrill et al. | 53/412 |
| 4,112,651 | A * | 9/1978 | Bardenhagen et al. | 53/449 |
| 5,003,755 | A * | 4/1991 | Draghetti | 53/466 |
| 5,701,725 | A * | 12/1997 | Neri et al. | 53/466 |
| 5,996,318 | A * | 12/1999 | Draghetti | 53/466 |
| 6,286,291 | B1 * | 9/2001 | Tale' et al. | 53/456 |
| 6,820,398 | B2 * | 11/2004 | Tale' et al. | 53/466 |
| 6,854,243 | B2 * | 2/2005 | Sendo et al. | 53/234 |
| 6,935,091 | B2 * | 8/2005 | Gamberini | 53/466 |
| 7,360,347 | B2 * | 4/2008 | Lanzarini et al. | 53/463 |

* cited by examiner

*Primary Examiner* — Sameh H. Tawfik
(74) *Attorney, Agent, or Firm* — Ladas & Parry LLP

(57) ABSTRACT

A wrapping method and unit for producing a package containing a group of cigarettes and having a cigarette extraction opening; a sheet of wrapping material, complete with the cigarette extraction opening, is fed into a pocket of a wrapping wheel so that the sheet of wrapping material folds into a U inside the pocket; then the group of cigarettes is fed into the pocket containing the U-folded sheet of wrapping material.

12 Claims, 13 Drawing Sheets

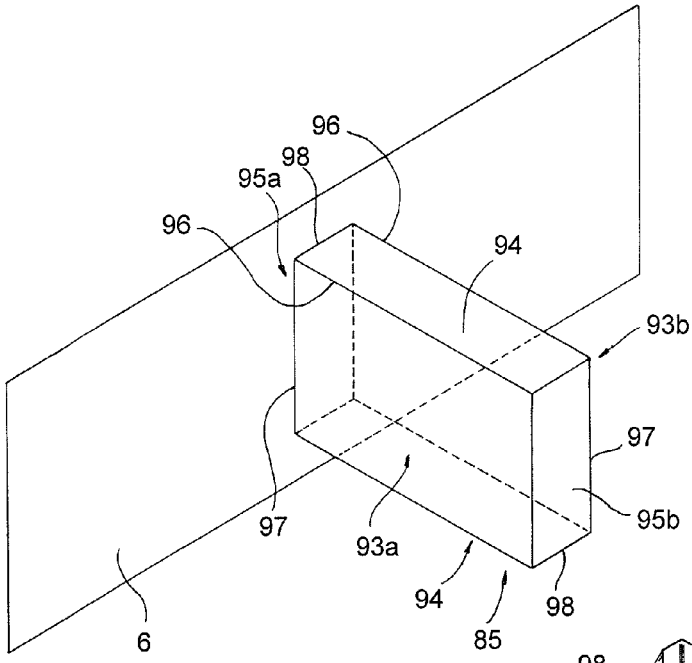
Fig.13
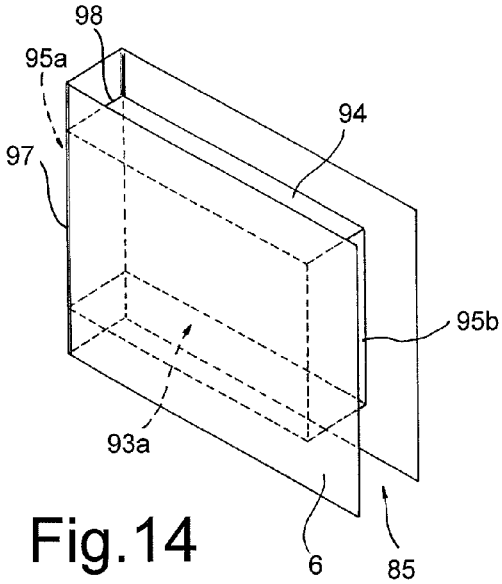
Fig.14
Fig.15
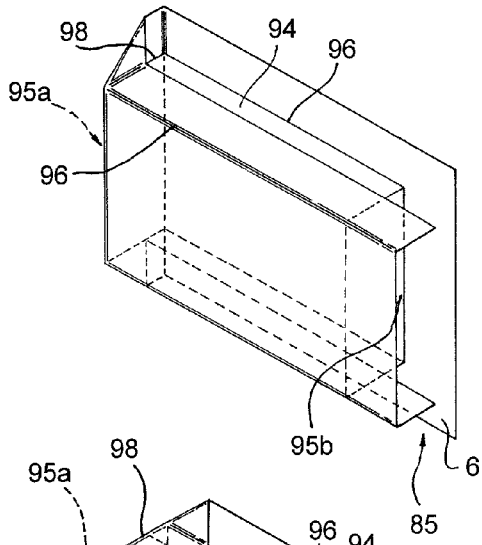
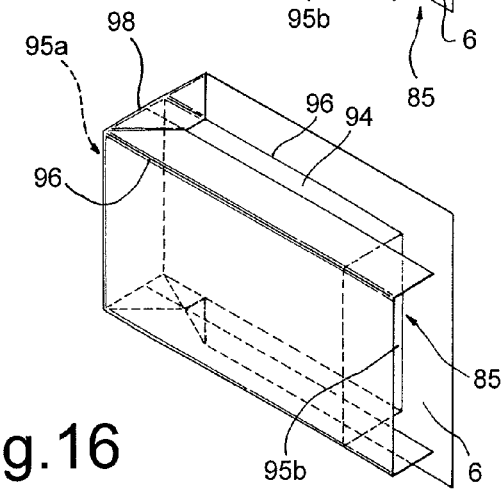
Fig.16

WRAPPING METHOD AND UNIT FOR FOLDING A SHEET OF WRAPPING MATERIAL ABOUT A GROUP OF CIGARETTES

TECHNICAL FIELD

The present invention relates to a wrapping method and unit for folding a sheet of wrapping material about a group of cigarettes.

BACKGROUND ART

A packet of cigarettes normally comprises an inner package defined by a group of cigarettes wrapped in a sheet of wrapping material; and an outer package enclosing the inner package, and which may be defined by a sheet of wrapping material folded into a cup shape about the inner package (soft packet of cigarettes), or by a rigid, hinged-lid box formed by folding a rigid blank about the inner package (rigid packet of cigarettes).

In a conventional packet of cigarettes, the group of cigarettes is wrapped internally in a rectangular sheet of foil inner wrapping material with no glue, and is packed externally in a rectangular sheet of outer packing material which is stabilized using glue.

Tobacco is highly sensitive to environment. That is, in contact with the atmosphere, its organic characteristics tend to vary alongside variations in humidity (by losing or absorbing too much moisture) or due to evaporation of the volatile substances with which the tobacco is impregnated (especially in the case of aromatic cigarettes treated with spices). To preserve the tobacco, packets of cigarettes are therefore cellophane-wrapped, i.e. wrapped in a heat-sealed overwrapping of airtight plastic material. This, however, may not always be sufficient to fully preserve the tobacco in the packet, especially if the packet is consumed some time after manufacture. Moreover, when the packet is unsealed, the overwrapping is removed, thus exposing the tobacco to the atmosphere, and, if the cigarettes are not consumed soon after the packet is unsealed, the organic characteristics of the remaining cigarettes may deteriorate.

In an attempt to eliminate this drawback, U.S. Pat. No. 4,300,676A1 proposes a rigid packet of cigarettes, in which the inner package is airtight, and comprises a sheet of airtight, heat-seal wrapping material having a cigarette extraction opening.

It has been observed that folding the sheet of inner wrapping material about the group of cigarettes may damage the ends of the cigarettes, thus resulting in localized deformation (of both the filter ends and the plain ends where the tobacco is exposed), and/or tobacco spill (i.e. tobacco fallout, obviously only from the plain ends where the tobacco is exposed). This applies in particular to the corner cigarettes in the group, though damage is also evident in all the outermost cigarettes, i.e. located along the fold lines of the sheet of inner wrapping material. Folding a sheet of airtight inner wrapping material is especially damaging to the cigarettes, on account of airtight sheets being thicker (and therefore stiffer) than conventional sheets of foil inner wrapping material. In the packet of cigarettes described in U.S. Pat. No. 4,300,676A1, the sheet of airtight inner wrapping material is preferably folded into a U at the filters of the cigarettes, so that the filters are located at the extraction opening, as in practically all currently marketed packets of cigarettes. When folding the sheet of airtight wrapping material into a U, however, the filters of the cigarettes are subjected to severe mechanical stress. It is important to bear in mind that the filters are visible when the packet is opened, so any deformed filters are particularly negative by giving the impression the cigarettes are flawed. Moreover, the above wrapping method fails to provide for forming square edges at the filters, on account of the stiffness of the sheet of inner wrapping material deforming the filters and so resulting in the formation of rounded edges. The fact that the inner package is rounded as opposed to square is particularly undesirable, by resulting in an overall look of the visible portion of the inner package that is not very popular with consumers, who tend to opt for inner packages with decidedly sharp edges.

DISCLOSURE OF THE INVENTION

It is an object of the present invention to provide a wrapping method and unit for folding a sheet of wrapping material about a group of cigarettes, which wrapping method and unit are cheap and easy to implement, and designed to eliminate the aforementioned drawbacks.

According to the present invention, there are provided a wrapping method and unit for folding a sheet of wrapping material about a group of cigarettes, as claimed in the attached Claims.

BRIEF DESCRIPTION OF THE DRAWINGS

A number of non-limiting embodiments of the present invention will be described by way of example with reference to the accompanying drawings, in which:

FIGS. 13-17 show schematic views in perspective of successive folding steps performed on the FIG. 12 wrapping unit to fold a sheet of wrapping material about a tubular spindle to form a tubular wrapping with one open end.

PREFERRED EMBODIMENTS OF THE INVENTION

Figure 1:
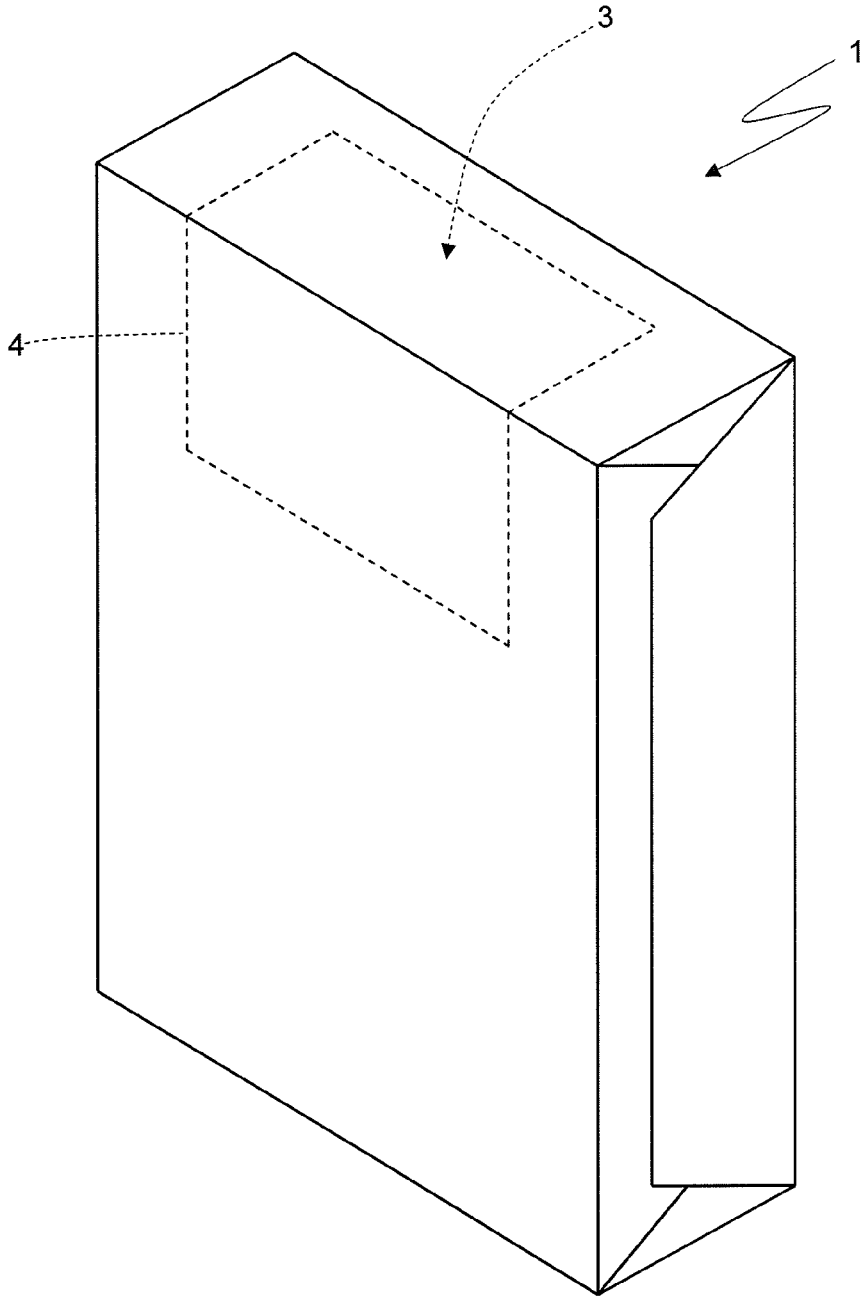
FIG. 1 shows a front view in perspective of a package of cigarettes.

Number 1 in FIG. 1 indicates as a whole a package of cigarettes similar to that described in U.S. Pat. No. 4,300,676A1. Package 1 of cigarettes encloses a parallelepiped-shaped group 2 of cigarettes (FIG. 2), and has a cigarette extraction opening 3, at the top and front, bounded by a tear line 4 and covering a portion of a front wall of package 1, and a portion of a top wall of package 1. To unseal package 1, the user tears the package along tear line 4 to eliminate the package at extraction opening 3 and so access the cigarettes in group 2 through extraction opening 3.

As described in U.S. Pat. No. 4,300,676A1, package 1 of cigarettes as described above can be inserted inside a known rigid, hinged-lid cigarette packet.

Package 1 is formed by folding a rectangular sheet 6 (shown spread out in FIG. 5) of airtight, heat-seal plastic wrapping material directly about group 2 of cigarettes and in direct contact with the cigarettes. Once sheet 6 of wrapping material is folded about group 2 of cigarettes to form package 1, the shape of package 1 is stabilized by heat sealing the superimposed portions of sheet 6 of wrapping material. Before being folded about group 2 of cigarettes, sheet 6 of wrapping material is cut along tear line 4 to define extraction opening 3.

Figure 2:
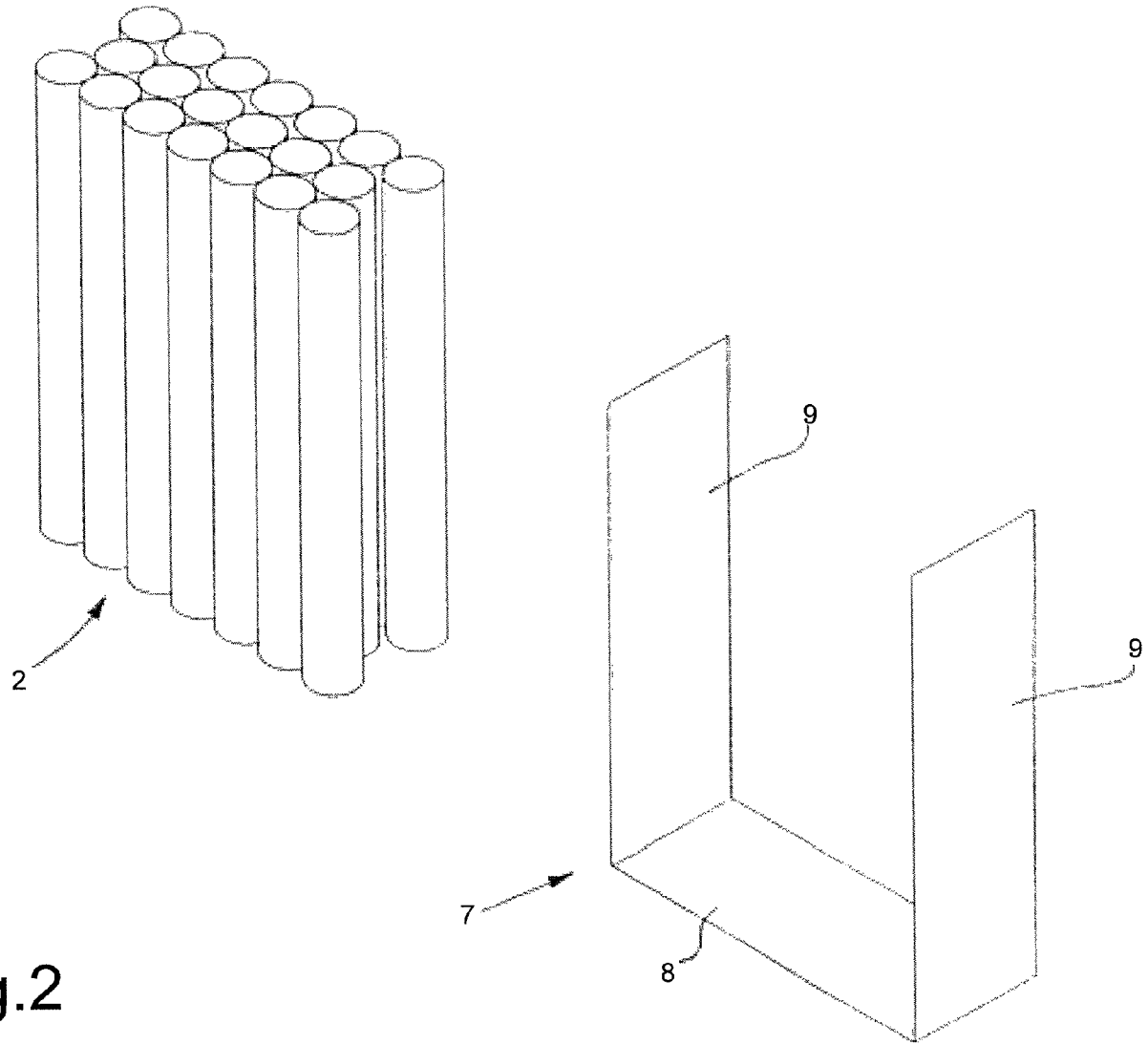
FIG. 2 shows an exploded view in perspective of the FIG. 1 package.

As shown in FIG. 2, package 1 comprises a U-shaped stiffener 7 of rigid cardboard, which is inserted inside package 1, contacting group 2 of cigarettes. Stiffener 7 comprises a rectangular central panel 8, which is positioned contacting a bottom wall of group 2 defined by the tips of the cigarettes; and two lateral wings 9 connected to the short sides of central panel 8 along two fold lines, and positioned contacting the minor lateral walls of group 2 defined by the cylindrical lateral walls of the cigarettes.

Figure 4:
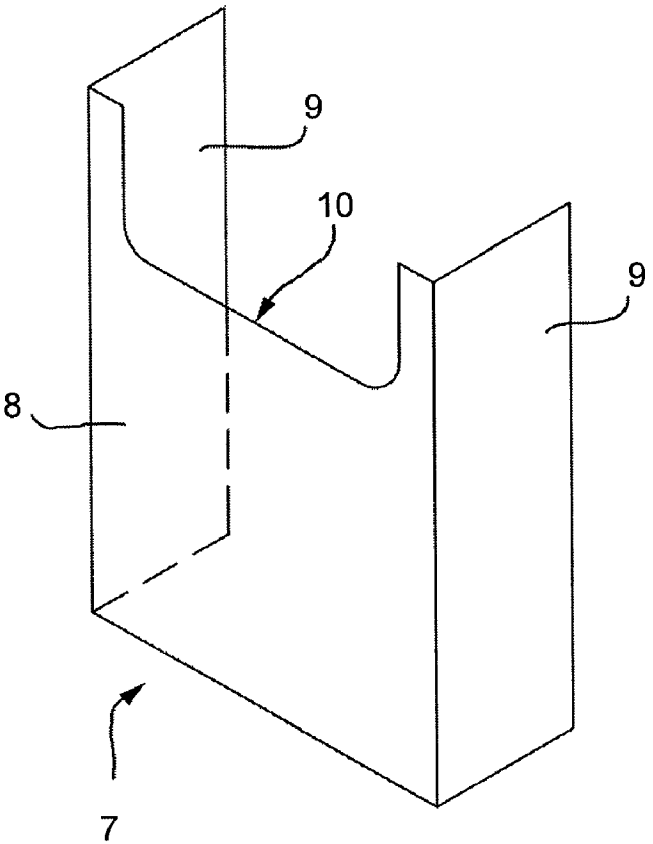
FIGS. 3 and 4 show views in perspective of two variations of a stiffener of the FIG. 2 package.
Figure 3:
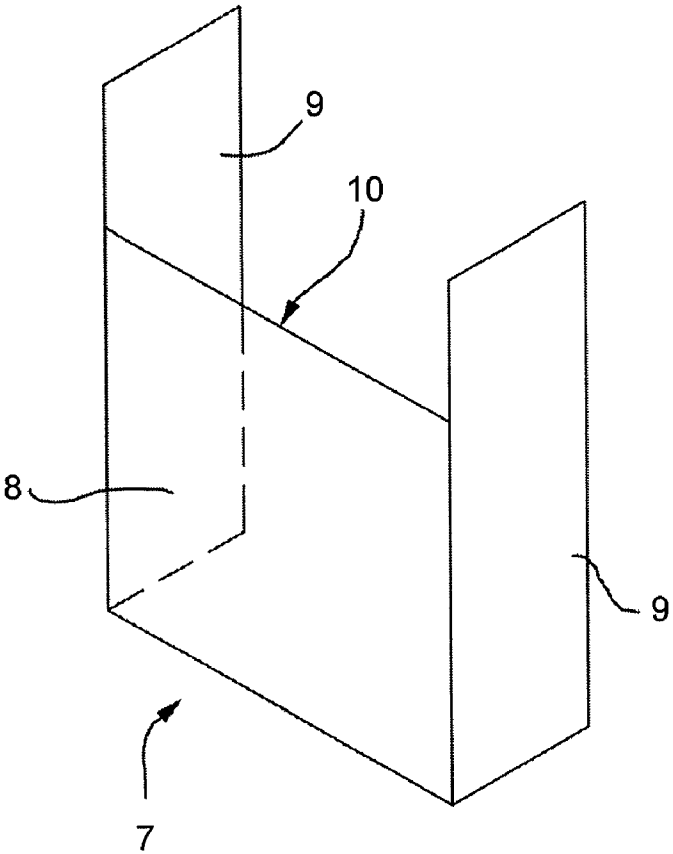

In the FIGS. 3 and 4 variations, central panel 8 of stiffener 7 is positioned contacting a front wall of group 2 defined by the cylindrical lateral walls of the cigarettes. As shown in FIGS. 3 and 4, central panel 8 of stiffener 7 has a top window 10, which is located at cigarette extraction opening 3 to prevent central panel 8 from obstructing withdrawal of the cigarettes. The FIGS. 3 and 4 embodiments differ solely in the shape of top window 10.

Stiffener 7 serves to stiffen and keep the shape of package 1, and so prevent the partly emptied package 1 from collapsing, thus making it difficult to withdraw the remaining cigarettes. Another function of stiffener 7 is to provide adequate mechanical protection of the cigarettes when folding sheet 6 of wrapping material, adequate mechanical and thermal protection of the cigarettes when heat sealing the superimposed portions of sheet 6 of wrapping material, and adequate mechanical protection of the cigarettes when handling package 1.

Figure 5:
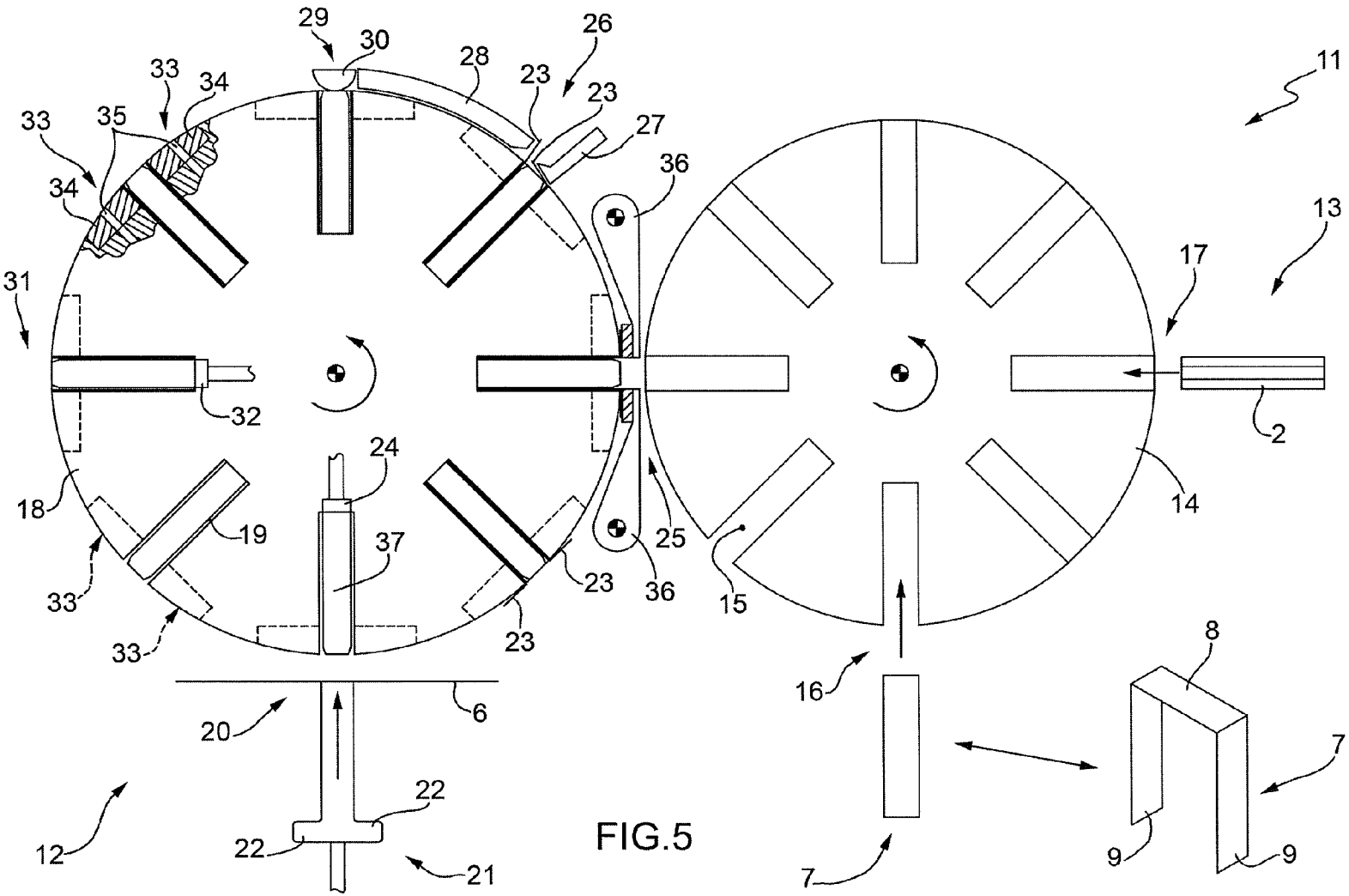
FIG. 5 shows a schematic front view, with parts removed for clarity, of a cigarette packing machine wrapping unit for producing the FIG. 1 package of cigarettes and in accordance with the present invention.

Number 11 in FIG. 5 indicates as a whole a packing machine for producing package 1 as described above.

Packing machine 11 comprises a group-forming unit (not shown in FIG. 5) for successively forming groups 2 of cigarettes; and a wrapping unit 12 (shown in FIG. 5) for wrapping and heat sealing a respective sheet 6 of wrapping material about each group 2 of cigarettes. It is important to note that packing machine 11 may comprise only the group-forming unit (not shown in FIG. 5) and wrapping unit 12; in which case, each package 1 as described above is a finished marketable product. Alternatively, packing machine 11 may also comprise a known packing station for packing each package 1 in a respective outer package, which encloses package 1 and may be defined by a sheet of outer wrapping material folded into a cup shape about package 1 (soft packet of cigarettes), or by a rigid, hinged-lid box formed by folding a rigid blank about package 1 (rigid packet of cigarettes).

Between the group-forming unit (not shown) and wrapping unit 12, a transfer station 13 transfers groups 2 of cigarettes from the group-forming unit (not shown) to wrapping unit 12.

Wrapping unit 12 in FIG. 5 comprises an input wheel 14, which receives groups 2 of cigarettes from the group-forming unit (not shown), rotates in steps (anticlockwise in FIG. 5) about a horizontal axis of rotation, and supports a number of peripheral pockets 15, each for housing a group 2 of cigarettes.

At a feed station 16, each pocket 15 on input wheel 14 is fed with a stiffener 7, which is folded into a U inside pocket 15. Normally, each stiffener 7 is positioned flat (i.e. not folded) in front of the inlet of respective pocket 15 at feed station 16, and is inserted inside pocket 15, and simultaneously folded into a U against the inlet of pocket 15, by a reciprocating pusher (not shown). Next, at a feed station 17 downstream from feed station 16 in the rotation direction of input wheel 14, each pocket 15 is fed with a group 2 of cigarettes, which is pushed into pocket 15 and into the previously U-folded stiffener 7 by a reciprocating pusher (not shown).

In an alternative embodiment not shown, feed station 16 is eliminated, and stiffener 7 and respective group 2 of cigarettes are inserted together into a respective pocket 15 on input wheel 14 at feed station 17. In which case, each stiffener 7 is placed flat in front of the inlet of pocket 15, and is pushed into pocket 15 by insertion of group 2 of cigarettes into pocket 15.

Wrapping unit 12 comprises a wrapping wheel 18 located alongside input wheel 14, and which rotates in steps (anticlockwise in FIG. 5) about a horizontal axis of rotation parallel to the axis of rotation of input wheel 14, and supports a number of peripheral pockets 19, each for housing a group 2 of cigarettes.

At a feed station 20, a flat sheet 6 of wrapping material, complete with cigarette extraction opening 3, is fed up to a respective empty pocket 19; and a reciprocating inserter 21, moving back and forth at feed station 20 in a direction perpendicular to the axis of rotation of wrapping wheel 18, inserts sheet 6 of wrapping material into pocket 19, so that sheet 6 is folded into a U inside pocket 19. In other words, inserter 21 pushes a central portion of sheet 6 of wrapping material inside pocket 19, so sheet 6 folds into a U against the inlet of pocket 19.

In a preferred embodiment, inserter 21 has two lateral projections 22, which, once sheet 6 of wrapping material is fed into pocket 19, press the two free flaps 23 of the U-folded sheet 6, projecting from pocket 19, against wrapping wheel 18. In other words, at lateral projections 22, inserter 21 negatively reproduces the shape of wrapping wheel 18 at the inlet of pocket 19, so as to press the two free flaps 23 of the U-folded sheet 6, projecting from pocket 19, against wrapping wheel 18.

Wrapping wheel 18 comprises a lead-in device 24 located at the centre of wrapping wheel 18, and which moves back and forth in the insertion direction of sheets 6 inside pockets 19, and cooperates with inserter 21 when inserting each sheet 6 inside a pocket 19. More specifically, lead-in device 24 on one side, and inserter 21 on the other side, grip a central portion of sheet 6 to clamp and prevent lateral slip of sheet 6 as it is inserted inside pocket 19. In other words, once a sheet 6 of wrapping material is positioned flat in front of the inlet of pocket 19, lead-in device 24 moves through pocket 19 towards and just short of touching sheet 6; at the same time, inserter 21 begins pressing against sheet 6, on the opposite side to lead-in device 24, so as to grip sheet 6 together with lead-in device 24. At this point, inserter 21 and lead-in device 24 move together to the bottom of pocket 19 to ease sheet 6, gripped between them at all times, into pocket 19. To effectively grip sheet 6 and compensate for any construction tolerances and slack due to wear, lead-in device 24 and/or inserter 21 have/has an elastic member which is compressed elastically when gripping sheet 6.

At a transfer station 25 between input wheel 14 and wrapping wheel 18 and downstream from feed station 20 in the rotation direction of wrapping wheel 18, each group 2 of cigarettes, together with respective stiffener 7, is transferred from a pocket 15 on input wheel 14 to a pocket 19 on wrapping wheel 18 containing a U-folded sheet 6 of wrapping material. As it is inserted inside pocket 19 containing the U-folded sheet 6, group 2 of cigarettes, together with respective stiffener 7, is therefore enclosed inside sheet 6.

At a wrapping station 26 downstream from transfer station 25 in the rotation direction of wrapping wheel 18, the two free flaps 23 of the U-folded sheet 6 projecting from pocket 19 are folded one on top of the other and onto group 2 of cigarettes to form sheet 6 into a tubular shape. More specifically, during a stop of wrapping wheel 18, a movable folder 27 folds the rear free flap 23 onto group 2 of cigarettes (i.e. in the same direction as the rotation direction of wrapping wheel 18); and, at the next step of wrapping wheel 18, a fixed folder 28 folds the front free flap 23 onto group 2 of cigarettes and on top of the already folded rear flap 23 (i.e. in the opposite direction to the rotation direction of wrapping wheel 18).

At a sealing station 29 downstream from wrapping station 26 in the rotation direction of wrapping wheel 18, the two superimposed flaps 23 of sheet 6 are heat sealed, to stabilize the tubular shape of sheet 6, by a heat-seal device 30 fitted to wrapping wheel 18, and which moves back and forth to and from wrapping wheel 18.

Finally, at a transfer station 31 downstream from sealing station 29 in the rotation direction of wrapping wheel 18, the tubular sheet 6 containing group 2 and stiffener 7 is expelled from pocket 19 of wrapping wheel 18 and fed to further known folding members (not shown) to finish folding sheet 6 about group 2 to form package 1, the final shape of which is stabilized by heat sealing. By way of example, the further known folding members (not shown) may be of the type described in Patent Application IT2007BO00593.

Wrapping wheel 18 comprises a pusher 32 located at the centre of wrapping wheel 18, and which moves back and forth in the transfer direction of groups 2 at transfer station 31 to push each tubular sheet 6, containing group 2 and stiffener 7, out of pocket 19 of wrapping wheel 18.

In a preferred embodiment, at the inlet of each pocket 19, wrapping wheel 18 comprises two pneumatic members 33 located on opposite sides of the inlet of pocket 19, and which are connectable to a vacuum source (not shown) to exert suction, and to a compressed-air source (not shown) to exert thrust by means of compressed-air jets. More specifically, each pair of pneumatic members 33 comprises two contoured plates 34, between which the inlet of respective pocket 19 is defined; and each plate 34 has a number of through holes 35 connectable to the vacuum source or the compressed-air source.

Between feed station 20 (i.e. after sheet 6 is inserted fully inside pocket 19) and transfer station 25, pneumatic members 33 of each pocket 19 are used to retain by suction the two free flaps 23 of the U-folded sheet 6 projecting from pocket 19; and, between transfer station 25 (i.e. after group 2 and stiffener 7 are fully inserted inside pocket 19) and wrapping station 26, pneumatic members 33 of each pocket 19 are used to lift, for subsequent folding, the two free flaps 23 of the U-folded sheet 6 projecting from pocket 19, by means of respective compressed-air jets on opposite sides of pocket 19.

Pneumatic members 33 of each pocket 19 are not used between wrapping station 26 and feed station 20.

Instead of or in addition to compressed-air jets to lift the two free flaps 23 of the U-folded sheet 6 projecting from pocket 19, folder 27, on one side, may be operated differently to engage annular grooves in the upstream plate 34; and folder 28, on the other side, may also be operated in the same way to engage annular grooves in the downstream plate 34.

In a different embodiment not shown, plates 34 are hinged to wrapping wheel 18 to rotate, about axes of rotation parallel to the axis of rotation of wrapping wheel 18, between a withdrawn position, in which plates 34 are tangent to wrapping wheel 18, and a raised position, in which plates 34 are positioned radially with respect to wrapping wheel 18. In which case, the two free flaps 23 of the U-folded sheet 6 projecting from pocket 19 are raised by plates 34 rotating from the withdrawn position (assumed everywhere except for wrapping station 26) to the raised position (only assumed at wrapping station 26).

As stated, when feeding group 2 into pocket 19 at transfer station 25, the two free flaps 23 of the U-folded sheet 6 projecting from pocket 19 are gripped by suction against wrapping wheel 18 by pneumatic members 33, to prevent slippage of sheet 6 as group 2, together with stiffener 7, is inserted. When inserting group 2 inside pocket 19, however, the gripping action of pneumatic members 33 may not be sufficient to prevent a small amount of slippage of sheet 6, so, to ensure firm grip of sheet 6, when inserting group 2 inside pocket 19, transfer station 25 is equipped with a reciprocating mechanical clamp 36, which is pressed against wrapping wheel 18 to clamp the two free flaps 23 of the U-folded sheet 6, projecting from pocket 19, against wrapping wheel 18.

Each pocket 19 preferably comprises two lateral folders 37 located on opposite sides of pocket 19, and which serve to fold two end flaps 38 (FIG. 7) of sheet 6 squarely (i.e. 90°), as sheet 6 is inserted inside pocket 19. That is, the central portion of sheet 6 defining the base of the "U" has two opposite ends or end flaps 38, which must be folded squarely to complete folding sheet 6, and which are folded squarely by lateral folders 37. It is important to note that, in addition to folding the two end flaps 38 of sheet 6 squarely, the two lateral folders 37 also keep the two end flaps 38 folded down as pocket 19 moves from feed station 20 to transfer station 31.

Figure 6:
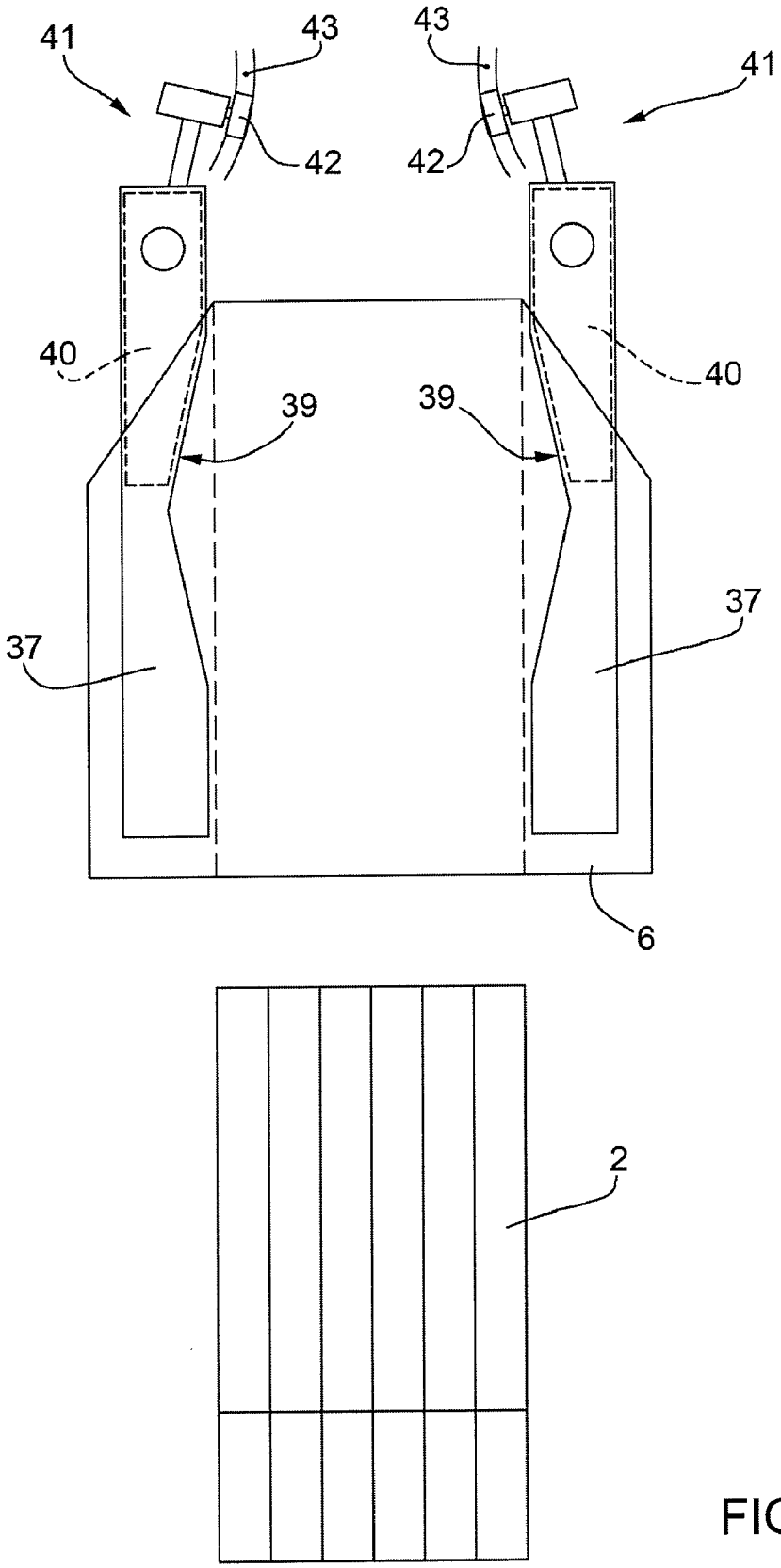
FIGS. 6 and 7 show schematic plan views, with parts removed for clarity, of two lateral folders of a pocket on a wrapping wheel of the FIG. 5 wrapping unit, and in two different positions.
Figure 7:
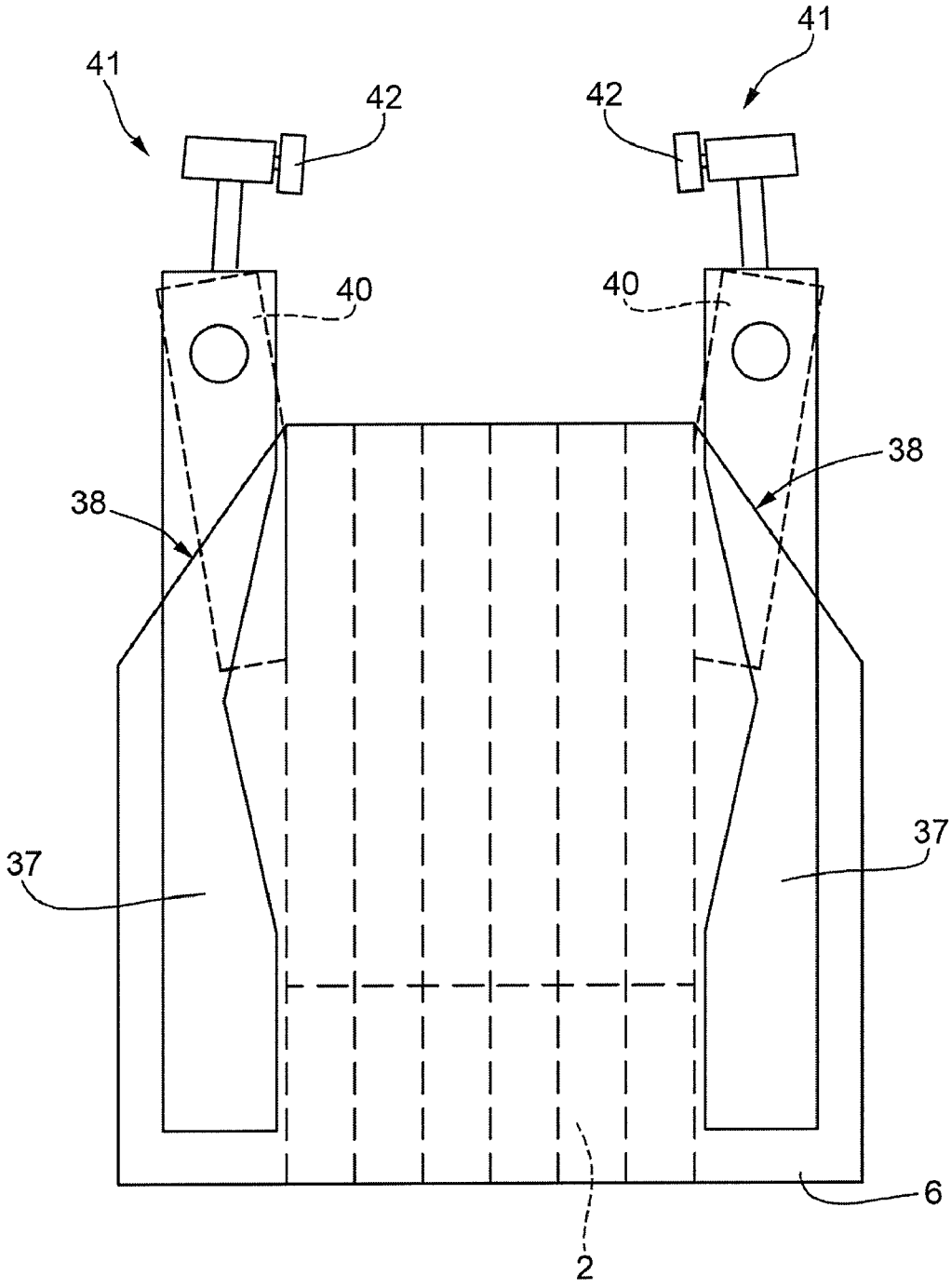

In a preferred embodiment shown in FIGS. 6 and 7, each lateral folder 37 has a central recess 39 facing inwards of pocket 19. As shown at the top in FIG. 7, the function of recesses 39 is to allow respective end flaps 38 to remain slightly raised (i.e. not folded down completely squarely), so as to prevent the end of group 2, as it is inserted inside pocket 19 and therefore inside the U-folded sheet 6, from jamming against end flaps 38. That is, if the two end flaps 38 were to be folded perfectly squarely, the distance between them would substantially equal the width of group 2, and, as group 2 is inserted inside sheet 6, the end of group 2 could jam against end flaps 38. On the other hand, by keeping end flaps 38 slightly raised (i.e. not folded completely squarely), as shown at the top in FIG. 7, the distance between end flaps 38 is much greater than the width of group 2, thus preventing the end of group 2 from jamming against end flaps 38 as group 2 is inserted inside sheet 6.

Each lateral folder 37 preferably comprises a movable portion 40 which is moved into an open position (shown at the top in FIG. 7) forming recess 39 facing inwards of pocket 19 as group 2 is inserted inside pocket 19, and is moved into a closed position (shown at the bottom in FIG. 7) substantially eliminating recess 39 facing inwards of pocket 19 once group 2 has been inserted inside pocket 19. In other words, movable portion 40 of each lateral folder 37 is moved into an open position (shown at the top in FIG. 7) forming recess 39 as group 2 is inserted inside pocket 19, and is moved into a closed position (shown at the bottom in FIG. 7) substantially eliminating recess 39 once group 2 has been inserted inside pocket 19. Recesses 39 are therefore only formed when needed, i.e. as group 2 is inserted inside pocket 19, to prevent group 2 from jamming against end flaps 38, and are eliminated once group 2 is fully inserted inside pocket 19 and hence inside the U-folded sheet 6.

By way of example, portions 40 of lateral folders 37 are hinged to wrapping wheel 18 and rotated between the open position and the closed position by a cam system 41 (shown schematically in FIGS. 6 and 7), which comprises two cam follower rollers 42 integral with portions 40, and two fixed cams 43 cooperating with cam follower rollers 42.

In a different embodiment not shown, lateral folders 37 have no movable portions 40, and recesses 39 are permanent.

In the FIG. 5-7 embodiment of wrapping unit 12, group 2 plays no part in folding sheet 6 into a U, which is done entirely at feed station 20, long before group 2 is inserted at transfer station 25. As such, both ends of the cigarettes in group 2 undergo absolutely no mechanical stress when folding sheet 6, and both the filters and the plain ends of the cigarettes undergo no deformation. Moreover, by virtue of inserter 21 cooperating with the inlets of pockets 19, sheet 6 is first folded between appropriately contoured metal (i.e. rigid, non-deformable) parts, thus producing decidedly sharp edges at extraction opening 3 of package 1, and an attractive square visible top portion of package 1.

In the preferred embodiment shown in FIG. 5, stiffener 7 is also folded into a U with no help from group 2, which is therefore also protected against mechanical stress produced by folding stiffener 7.

Figure 8:
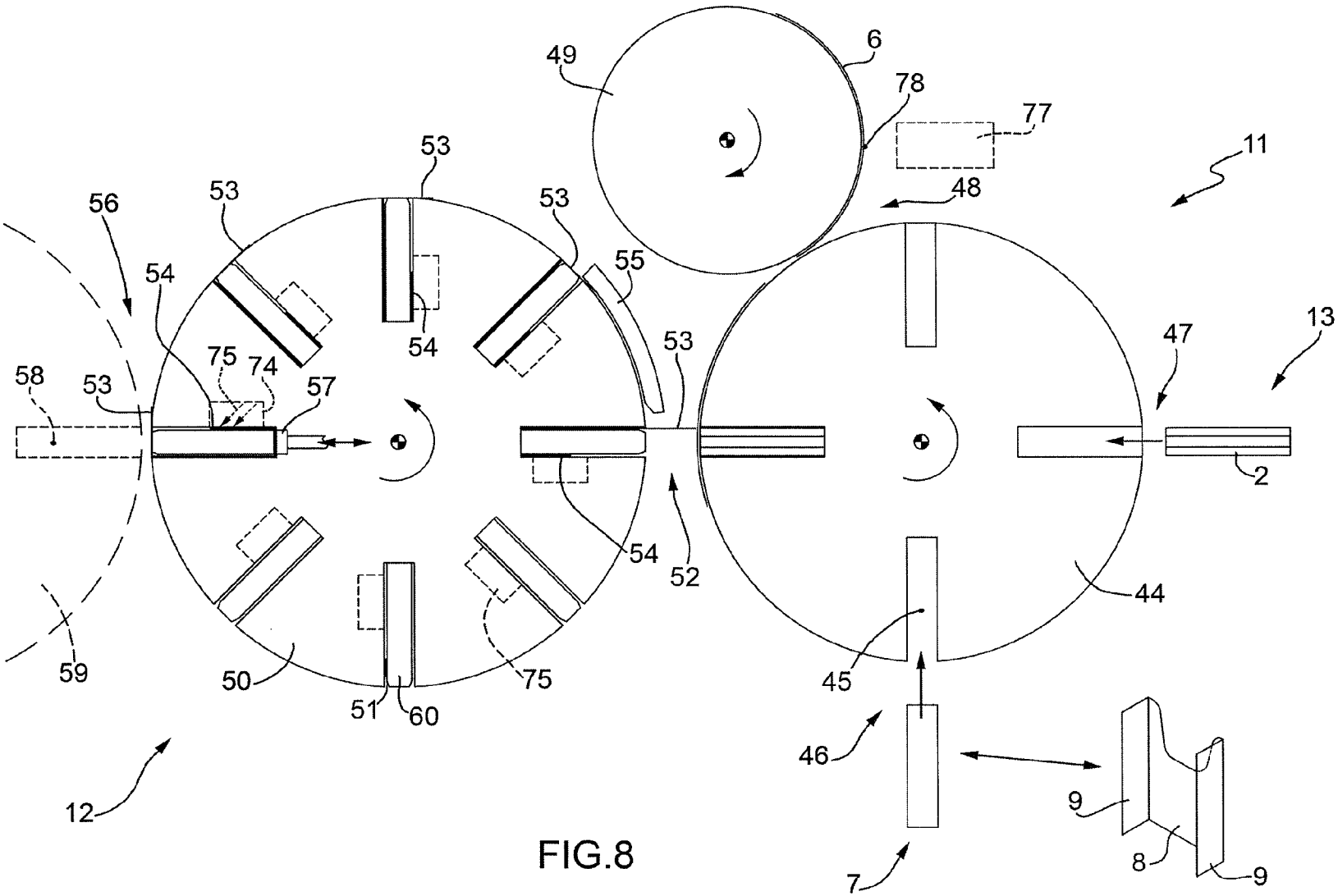
FIG. 8 shows a schematic front view, with parts removed for clarity, of an initial portion of a different embodiment of a cigarette packing machine wrapping unit for producing the FIG. 1 package of cigarettes and in accordance with the present invention.

FIG. 8 shows a different embodiment of wrapping unit 12, in which a respective sheet 6 of wrapping material is folded and heat sealed about each group 2 of cigarettes. It is important to note that, in the FIG. 5 wrapping unit 12, sheet 6 is folded into a U symmetrically about group 2, so, to form a tubular wrapping, the two free flaps 23 of sheet 6 are superimposed on a bottom wall of group 2 defined by the ends of the cigarettes; whereas, in the FIG. 8 wrapping unit 12, sheet 6 is folded into a U asymmetrically about group 2, so, to form a tubular wrapping, the two flaps of sheet 6 are superimposed on a front wall of group 2 defined by the cylindrical lateral walls of the cigarettes. In the FIG. 5 wrapping unit 12, stiffener 7 is therefore as shown in FIG. 2, in that central panel 8 must rest on the bottom wall of group 2 to protect the bottom wall when folding and heat sealing the two free flaps 23 of sheet 6; whereas, in the FIG. 8 wrapping unit 12, stiffener 7 is as shown in FIG. 3 or 4, in that central panel 8 must rest on the front wall of group 2 to protect the front wall when folding and heat sealing the two flaps of sheet 6.

Wrapping unit 12 in FIG. 8 comprises an input wheel 44, which receives groups 2 of cigarettes from the group-forming unit (not shown), rotates in steps (anticlockwise in FIG. 8) about a horizontal axis of rotation, and supports a number of peripheral pockets 45, each for housing a group 2 of cigarettes.

At a feed station 46, each pocket 45 on input wheel 44 is fed with a stiffener 7, which is folded into a U inside pocket 45. Normally, each stiffener 7 is positioned flat (i.e. not folded) in front of the inlet of respective pocket 45 at feed station 46, and is inserted inside pocket 45, and simultaneously folded into a U against the inlet of pocket 45, by a reciprocating pusher (not shown). Next, at a feed station 47 downstream from feed station 46 in the rotation direction of input wheel 44, each pocket 45 is fed with a group 2 of cigarettes, which is pushed into pocket 45 and into the previously U-folded stiffener 7 by a reciprocating pusher (not shown).

In an alternative embodiment not shown, feed station 46 is eliminated, and stiffener 7 and respective group 2 of cigarettes are inserted together into a respective pocket 45 on input wheel 44 at feed station 47. In which case, each stiffener 7 is placed flat in front of the inlet of pocket 45, and is pushed into pocket 45 by insertion of group 2 of cigarettes into pocket 45.

At a feed station 48 downstream from feed station 47 in the rotation direction of input wheel 44, each pocket 45 receives a sheet 6 of wrapping material, which is laid flat on the periphery of input wheel 44 and over the inlet of pocket 45. By way of example, each sheet 6 of wrapping material may be retained flat on the periphery of input wheel 44 and over the inlet of respective pocket 45 by suction. In other words, the periphery of input wheel 44 has a number of holes located beneath sheet 6, and which are connected pneumatically to a vacuum source.

In the FIG. 8 embodiment, wrapping unit 12 comprises a feed wheel 49 located alongside input wheel 44 at feed station 48, and which rotates in steps (clockwise in FIG. 8) about a horizontal axis of rotation parallel to the axis of rotation of input wheel 44, and feeds sheets 6 successively to input wheel 44.

Wrapping unit 12 comprises a wrapping wheel 50 located alongside input wheel 44, and which rotates in steps (anticlockwise in FIG. 8) about a horizontal axis of rotation parallel to the axis of rotation of input wheel 44, and supports a number of peripheral pockets 51, each for housing a group 2 of cigarettes.

At a transfer station 52 between input wheel 44 and wrapping wheel 50, each group 2 of cigarettes, together with respective stiffener 7, is transferred from a pocket 45 on input wheel 44 to a pocket 51 on wrapping wheel 50. More specifically, at transfer station 52, each sheet 6 is positioned in front of the inlet of pocket 51 of wrapping wheel 50, so, as group 2, together with respective stiffener 7, is transferred from pocket 45 of input wheel 44 to pocket 51 of wrapping wheel 50, sheet 6 is intercepted by group 2 and folded into a U about group 2 as group 2 is inserted inside pocket 51 of wrapping wheel 50.

Sheet 6 is fed to input wheel 44 so as to be positioned asymmetrically in front of the inlet of pocket 51 of wrapping wheel 50. That is, at transfer station 52, the centreline of sheet 6 is offset with respect to the centreline of pocket 51 of wrapping wheel 50, so that sheet 6 folded into a U about group 2 has only one free outer flap 53 projecting from pocket 51, while an inner flap 54, opposite the free outer flap 53, rests on a lateral wall of group 2 (with stiffener 7 in between) inside pocket 51.

Once group 2 and respective sheet 6 are fully inserted inside pocket 51, rotation of wrapping wheel 50 causes the free outer flap 53 of sheet 6 projecting from pocket 51 to impact a fixed folder 55, which folds the free outer flap 53 (in the opposite direction to the rotation direction of wrapping wheel 50) 90° over the inlet of pocket 51 and onto group 2.

Gradual step rotation of wrapping wheel 50 eventually brings each pocket 51, containing a group 2 and respective sheet 6, to a transfer station 56, where the tubular sheet 6, containing group 2 and stiffener 7, is expelled by a pusher 57 from pocket 51 of wrapping wheel 50 into a pocket 58 of a wrapping wheel 59.

Each pocket 51 preferably comprises two lateral folders 60 located on opposite sides of pocket 51, and which serve to fold two end flaps of sheet 6 squarely (i.e. 90°), as sheet 6 is inserted inside pocket 51. That is, the central portion of sheet 6 defining the base of the "U" has two opposite ends or end flaps, which must be folded squarely to complete folding sheet 6, and which are folded squarely by lateral folders 60. It is important to note that, in addition to folding the two end flaps of sheet 6 squarely, the two lateral folders 60 also keep the two end flaps folded down as pocket 51 moves from feed station 48 to transfer station 52.

Figure 9:
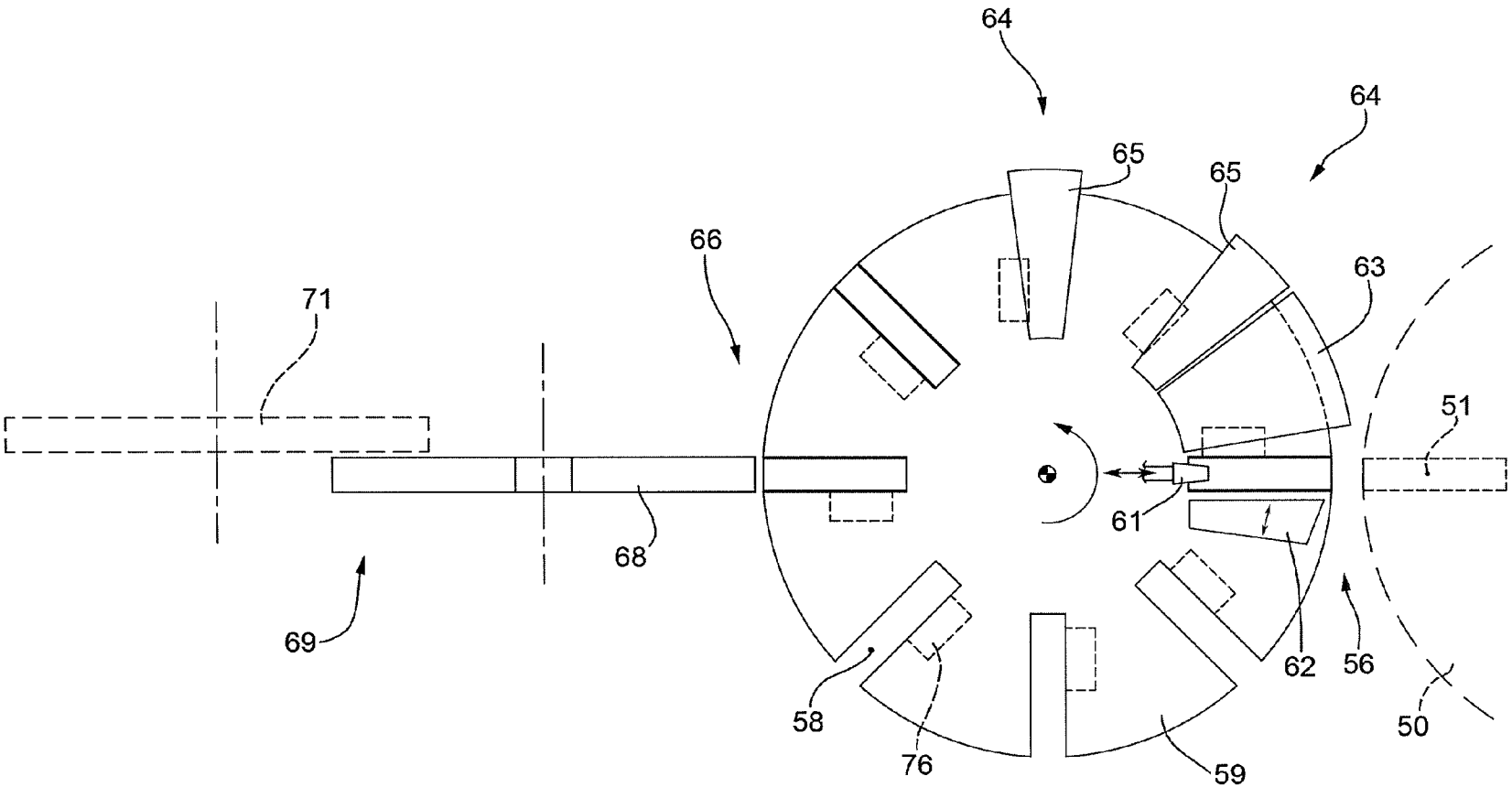
FIG. 9 shows a schematic front view, with parts removed for clarity, of an intermediate portion of the FIG. 8 wrapping unit.

As shown in FIG. 9, wrapping wheel 59 is located alongside wrapping wheel 50, rotates in steps (anticlockwise in FIG. 9) about a horizontal axis of rotation parallel to the axis of rotation of input wheel 44, and supports a number of peripheral pockets 58, each for housing a group 2 of cigarettes. Wrapping wheel 59 serves to complete folding sheet 6 about group 2, and so complete package 1 while group 2, together with sheet 6 and stiffener 7, is housed inside pocket 58.

During transfer from pocket 51 of wrapping wheel 50 to pocket 58 of wrapping wheel 59, the free outer flap 53 of sheet 6 is folded 90° onto group 2 and over the inner flap 54 of sheet 6 to form a tubular sheet 6. That is, a shoulder of pocket 58 of wrapping wheel 59 acts as a folder to further fold the free outer flap 53 of sheet 6 ninety degrees onto group 2 and over the inner flap 54 of sheet 6 as group 2 is inserted inside pocket 58.

Once group 2 and respective sheet 6 are fully inserted inside pocket 58, sheet 6 is tubular in shape, with two open lateral ends which must be folded onto group 2 (obviously, with stiffener 7 in between) to finish folding sheet 6 about group 2 and so form package 1.

To fold the two open lateral ends of tubular sheet 6, wrapping wheel 59 comprises a movable folder 61, which is located at transfer station 56, has two folding members (only one shown in FIG. 9) on opposite sides of pocket 58, and moves back and forth to fold end flaps of sheet 6 opposite the end flaps already folded by lateral folders 60 of pocket 51. Wrapping wheel 59 also comprises a movable folder 62, which is located at transfer station 56, has two folding members (only one shown in FIG. 9) on opposite sides of pocket 58, and moves back and forth to make a first fold of the open lateral ends of tubular sheet 6. Finally, wrapping wheel 59 comprises a fixed folder 63, which is located at transfer station 56, has two folding members (only one shown in FIG. 9) on opposite sides of pocket 58, and makes a second fold of the open lateral ends of tubular sheet 6 as step rotation of wrapping wheel 59 moves pocket 58 forward.

Wrapping wheel 59 also comprises two sealing stations 64 arranged successively downstream from transfer station 56 in the rotation direction of wrapping wheel 59, and each of which comprises two sealing devices 65 (only one shown in FIG. 9) located on opposite sides of pocket 58 to heat seal the superimposed portions of the lateral ends of sheet 6 and stabilize package 1.

At a transfer station 66 downstream from sealing stations 64 in the rotation direction of wrapping wheel 59, package 1 is expelled from pocket 58 of wrapping wheel 59 into a pocket 67 (FIG. 10) of a transfer wheel 68 located alongside wrapping wheel 59, and which rotates in steps (anticlockwise in FIG. 10) about a vertical axis of rotation perpendicular to the axis of rotation of wrapping wheel 59.

At a transfer station 69 downstream from transfer station 66 in the rotation direction of transfer wheel 68, package 1 is expelled from pocket 67 of transfer wheel 68 into a pocket 70 (FIG. 10) of a sealing wheel 71 located alongside transfer wheel 68, and which rotates in steps (anticlockwise in FIG. 10) about a vertical axis of rotation parallel to the axis of rotation of transfer wheel 68.

Sealing wheel 71 has a sealing station 72 located downstream from transfer station 69 in the rotation direction of sealing wheel 71, and which comprises a sealing device 73 to heat seal the superimposed portions of flaps 53 and 54 of sheet 6 to stabilize and finally complete package 1.

In a preferred embodiment shown in FIG. 8, each pocket 51 of wrapping wheel 50 comprises a pneumatic member 74 connected pneumatically to a compressed-air source to direct compressed-air jets 75 onto inner flap 54 of sheet 6 at transfer station 56. At transfer station 56, group 2, together with sheet 6, is transferred from pocket 51 of wrapping wheel 50 to pocket 58 of wrapping wheel 59 with the inner flap 54 of sheet 6 oriented in the transfer direction and therefore susceptible to slippage during transfer. To prevent this, pneumatic member 74 of pocket 51 of wrapping wheel 50 directs compressed-air jets 75 onto inner flap 54 of sheet 6 to exert air pressure on and keep inner flap 54 smoothed out in the correct position. In other words, pneumatic member 74 of pocket 51 of wrapping wheel 50 directs compressed-air jets 75 onto inner flap 54 of sheet 6 resting on a lateral wall of group 2, to hold inner flap 54 on the lateral wall during transfer from pocket 51 of wrapping wheel 50 to pocket 58 of wrapping wheel 59. Consequently, compressed-air jets 75 are directed in a direction inclined with respect to the lateral wall of group 2, and in the transfer direction from pocket 51 of wrapping wheel 50 to pocket 58 of wrapping wheel 59.

In a different embodiment shown by a dash line in FIG. 9, each pocket 58 of wrapping wheel 59 comprises a sealing device 76 for heat sealing a portion of outer flap 53 of sheet 6 superimposed on inner flap 54 of sheet 6, as pocket 58 moves from transfer station 56 to transfer station 66. In this embodiment, sealing wheel 71 is obviously either eliminated, or has no sealing station 72 and serves solely to transfer packages 1.

In a further embodiment shown by a dash line in FIG. 8, feed wheel 49 is connected to a gumming device 77 (e.g. a spray gumming device) to apply gum spots 78 to inner flap 54 of each sheet 6 to gum inner flap 54 (possibly temporarily, i.e. not necessarily permanently) to central panel 8 of stiffener 7. In other words, gum spots 78 fix inner flap 54 of sheet 6 to central panel 8 of stiffener 7 prior to transfer to pocket 58 of wrapping wheel 59, thus preventing any slippage of inner flap 54 of sheet 6 as group 2 and sheet 6 are transferred from pocket 51 of wrapping wheel 50 to pocket 58 of wrapping wheel 59. In this embodiment, pneumatic member 74 is not needed, on account of the pressure action of compressed-air jets 75 being replaced by the retaining action of gum spots 78. In a variation not shown, inner flap 54 of sheet 6 is fixed to central panel 8 of stiffener 7 by heat sealing as opposed to gumming; in which case, each pocket 51 of wrapping wheel 50 comprises a sealing device (identical to sealing device 76 already described) to heat seal inner flap 54 of sheet 6 to central panel 8 of stiffener 7, and the heat seal surface of central panel 8 of stiffener 7 is preferably coated with transparent heat-seal plastic material.

Figure 11:
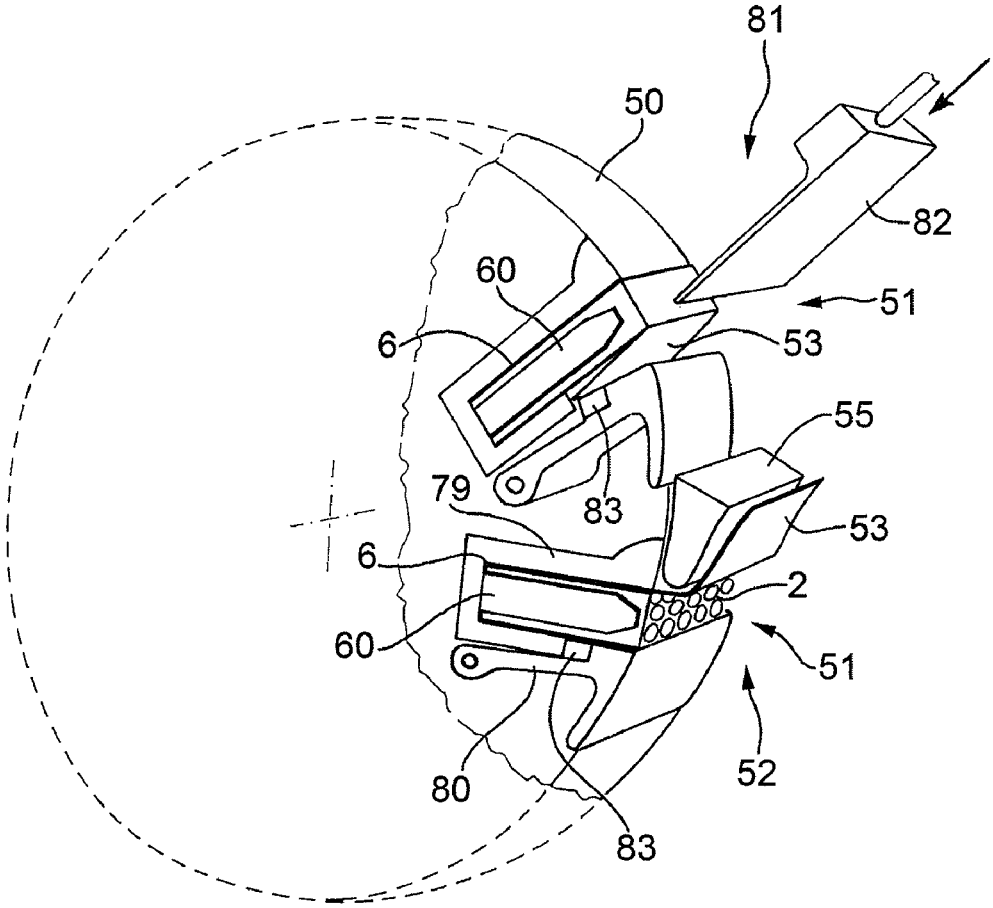
FIG. 11 shows a schematic front view, with parts removed for clarity, of a variation of a wrapping wheel of the FIG. 8 wrapping unit.

FIG. 11 shows a variation of wrapping wheel 50. As shown in FIG. 11, each pocket 51 is bounded laterally by a fixed wall 79, and by a movable wall 80 opposite fixed wall 79 and hinged centrally to wrapping wheel 50. More specifically, movable wall 80 is rotated, by a cam actuating system (not shown), between a closed position, in which movable wall 80 is parallel to fixed wall 79 and pocket 51 is substantially the same depth as group 2, and an open position, in which movable wall 80 is tilted in a "V" with respect to fixed wall 79, and pocket 51 is deeper than group 2.

As shown in FIG. 11, wrapping wheel 50 also comprises a wrapping station 81 located downstream from fixed folder 55, between transfer station 52 and transfer station 56, and which comprises a movable folder 82 movable radially with respect to wrapping wheel 50. When step rotation of wrapping wheel 50 stops pocket 51 at wrapping station 81, movable wall 80 of pocket 51 opens (i.e. moves from the closed to the open position), and movable folder 82 is simultaneously inserted radially inside pocket 51 (i.e. between group 2 and movable wall 80) to further fold the free outer flap 53 of sheet 6 ninety degrees onto group 2 to form a tubular sheet 6. Once the further fold of the free outer flap 53 of sheet 6 is completed, movable folder 82 returns to its original position outside wrapping wheel 50, and movable wall 80 of pocket 51 closes (i.e. moves from the open to the closed position). In other words, movable wall 80 of pocket 51 is temporarily detached from group 2 to make room for insertion of movable folder 82 inside pocket 51.

Figure 10:
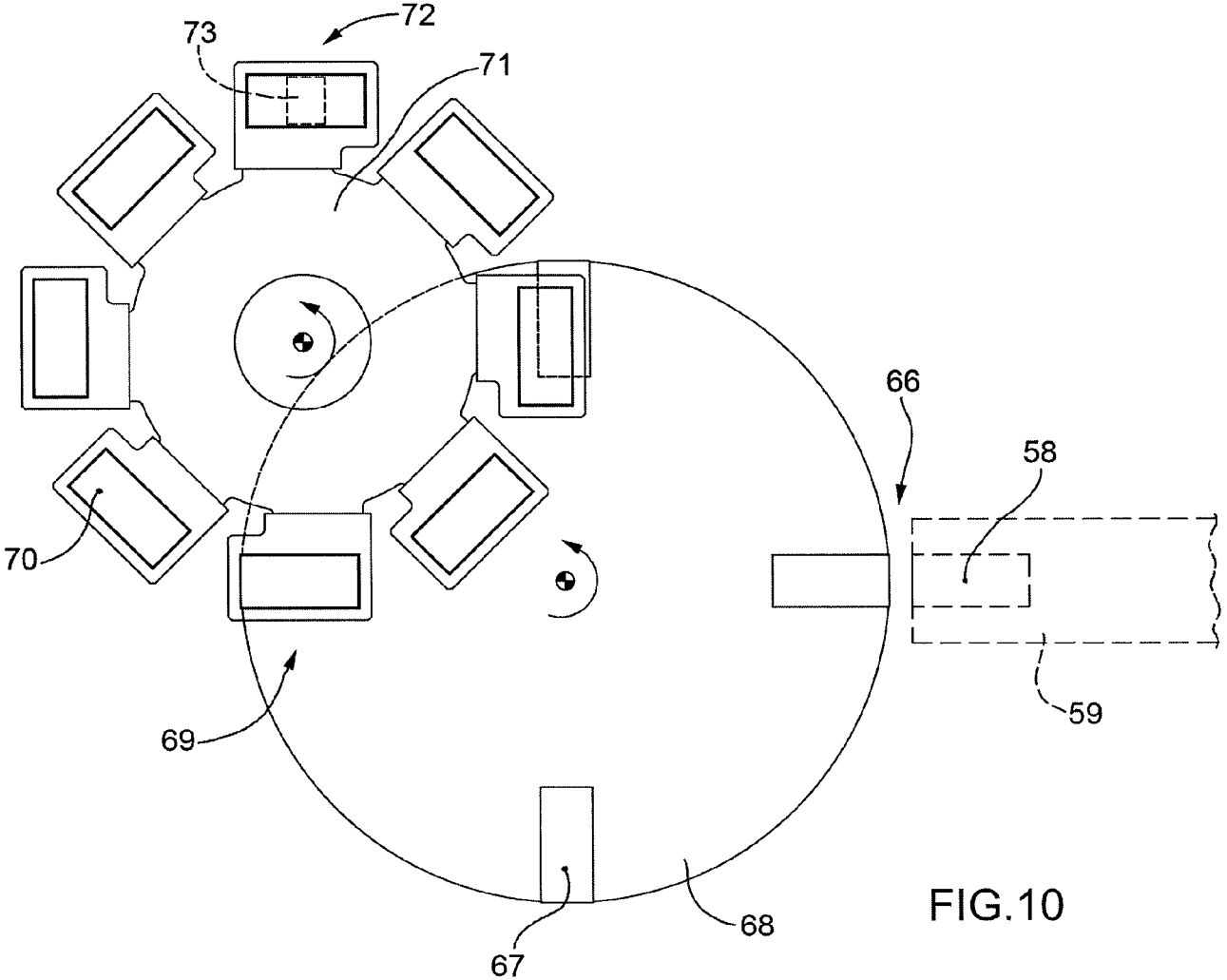
FIG. 10 shows a schematic plan view, with parts removed for clarity, of an end portion of the FIG. 8 wrapping unit.

In the FIG. 11 embodiment, further folding of the free outer flap 53 of sheet 6 to form a tubular sheet 6 therefore takes place at wrapping station 81, and not, as in the FIG. 10 variation, at transfer station 56.

In the FIG. 11 variation, movable wall 80 of each pocket 51 of wrapping wheel 50 preferably comprises a sealing device 83 for heat sealing a portion of outer flap 53 of sheet 6 superimposed on inner flap 54 of sheet 6, as pocket 51 moves from wrapping station 81 to transfer station 56. In this embodiment, sealing wheel 71 is obviously either eliminated, or has no sealing station 72 and serves solely to transfer packages 1.

The FIG. 8-11 embodiment of wrapping unit 12 produces a package 1 of the type shown in FIG. 1, in which flaps 53 and 54 of sheet 6 are superimposed on a front wall of group 2 defined by the cylindrical lateral walls of the cigarettes. This particular location of the superimposed flaps 53 and 54 of sheet 6 is highly popular but extremely difficult to achieve on known packing machines, whereas the wrapping unit 12 in FIGS. 8-11 enables it to be achieved easily, cheaply, and at extremely fast operating speeds.

Figure 12:
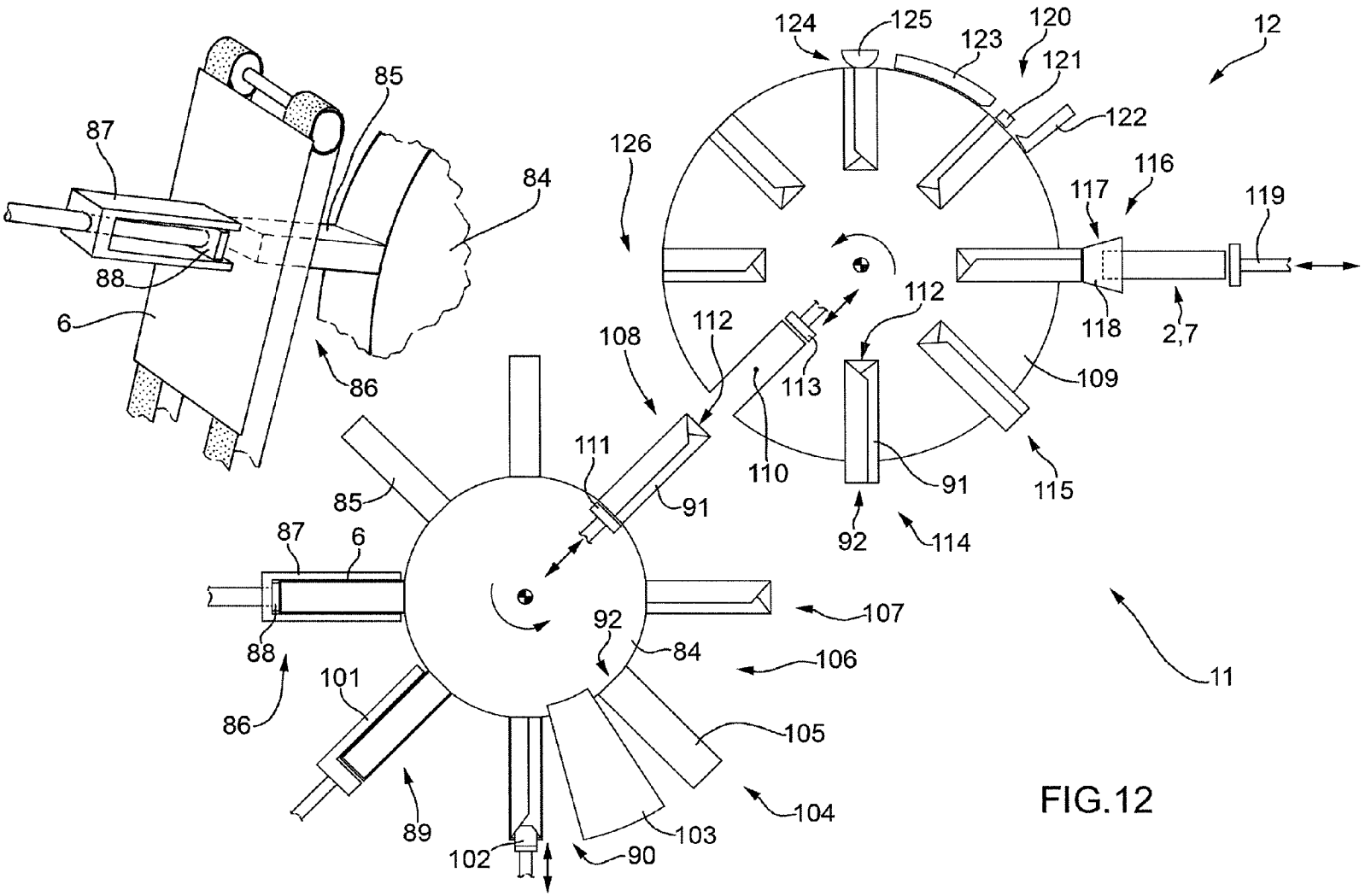
FIG. 12 shows a schematic front view, with parts removed for clarity, of a further embodiment of a cigarette packing machine wrapping unit for producing the FIG. 1 package of cigarettes and in accordance with the present invention.

FIG. 12 shows a different embodiment of wrapping unit 12, in which a sheet 6 of wrapping material is folded and heat sealed about each group 2 of cigarettes. In the FIG. 12 wrapping unit 12, as in the FIG. 5 wrapping unit 12, sheet 6 is folded into a U symmetrically about group 2, so that, to form a tubular wrapping, the two free flaps of sheet 6 are superimposed on a bottom wall of group 2 defined by the ends of the cigarettes.

The FIG. 12 wrapping unit 12 comprises a wrapping wheel 84 which rotates in steps (anticlockwise in FIG. 12) about a horizontal axis of rotation, and supports a number of peripheral tubular (i.e. hollow) spindles 85 projecting radially from the periphery of wrapping wheel 84. Each tubular spindle 85 is parallelepiped-shaped, has a cross section of substantially the same shape and size as a group 2 of cigarettes, and has a radial dimension larger than group 2 and at least equal to the corresponding dimension of sheet 6 folded into a U about tubular spindle 85.

At a feed station 86, each tubular spindle 85 receives a sheet 6, which is folded into a U about tubular spindle 85 as it stops. More specifically, at feed station 86, each sheet 6 is fed, flat, in front of tubular spindle 85, and is folded into a U about tubular spindle 85 by a U-shaped folder 87, which moves back and forth radially with respect to wrapping wheel 84 to enclose the outside of tubular spindle 85. In one embodiment, the U-shaped folder 87 is fitted with a suction pad 88, which is located at the centre of folder 87, moves independently of folder 87, and is brought into contact with a central portion of sheet 6 to grip the central portion of sheet 6 by suction and prevent slippage of sheet 6 as it is folded by folder 87.

At two successive folding stations 89 and 90 downstream from feed station 86, sheet 6 is folded about tubular spindle 85 to form a tubular wrapping 91 (FIG. 17) with an open end 92 through which a group 2 of cigarettes (FIG. 17) is then inserted inside tubular wrapping 91 as described in detail below. Next, as described in detail below, the folding of sheet 6 is completed by closing the open end 92 onto group 2 to form package 1, which is stabilized by heat sealing.

Each sheet 6 is folded about tubular spindle 85 as described in Patent Application IT2007BO00492, included herein by way of reference, and as shown in FIGS. 13-17. The way in which sheet 6 is folded about tubular spindle 85 to form the tubular wrapping 91 in FIG. 17 will now be described with reference to FIGS. 13-17.

As shown in FIG. 13, sheet 6 is in the form of an elongated rectangle with two opposite, parallel long sides, and two opposite, parallel short sides; and tubular spindle 85 is parallelepiped-shaped with a rectangular cross section, and comprises two opposite, parallel, rectangular major lateral walls 93 (only one shown in FIG. 13), two opposite, parallel, rectangular minor lateral walls 94 (only one shown in FIG. 13) smaller than major lateral walls 93, and two opposite, parallel open ends 95 (only one shown in FIG. 13). Four longitudinal edges 96 (only three shown in FIG. 13) are defined between the two major lateral walls 93 and the two minor lateral walls 94; four major transverse edges 97 (only three shown in FIG. 13) are defined between the two major lateral walls 93 and the two ends 95; and four minor transverse edges 98 (only three shown in FIG. 13) are defined between the two minor lateral walls 94 and the two ends 95.

As shown in FIG. 13, at feed station 86, a first end 95*a* of tubular spindle 85 is first brought into contact with the flat sheet 6, so that major transverse edges 97 of tubular spindle 85 are parallel to the short sides of sheet 6, and minor transverse edges 98 of tubular spindle 85 are parallel to the long sides of sheet 6. First end 95*a* of tubular spindle 85 is preferably positioned symmetrically in the centre of sheet 6 with respect to both the long and short sides of sheet 6. Next, as shown in FIG. 14, at feed station 86, sheet 6 is folded into a U about the major transverse edges 97 of first end 95*a*, so that sheet 6 completely covers both major lateral walls 93.

Figure 17:
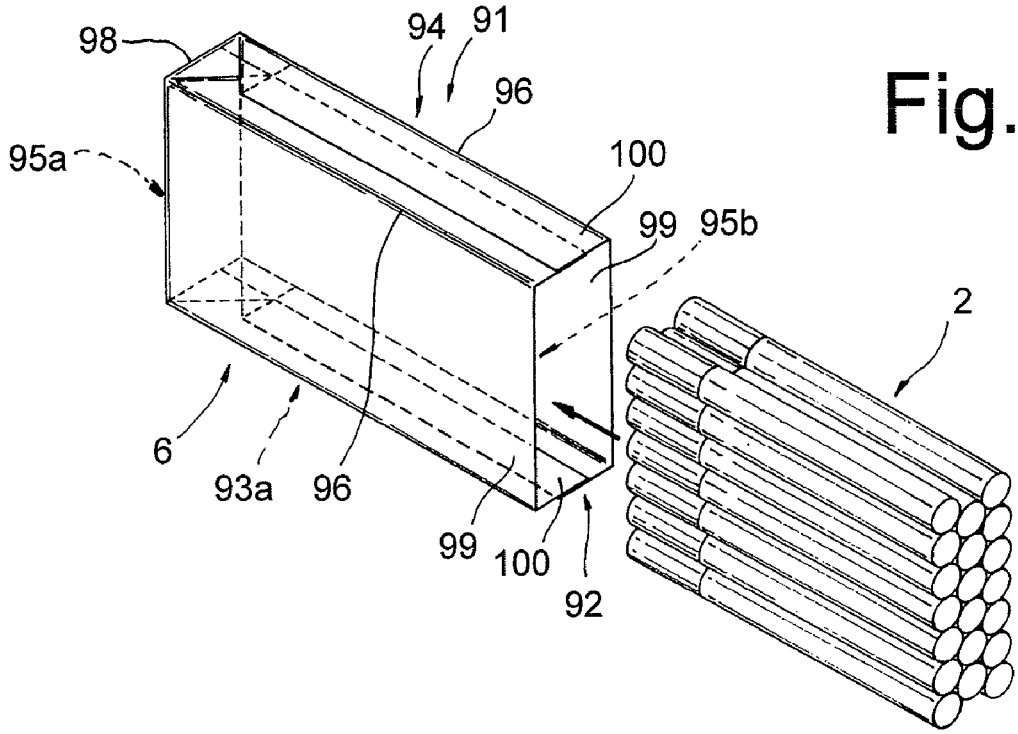

At this point, at wrapping station 89, sheet 6 is folded about the longitudinal edges 96 of a first major lateral wall 93*a* onto minor lateral walls 94 (FIG. 15). Next, at wrapping station 90, sheet 6 is folded about the minor transverse edges 98 of first end 95*a* onto minor lateral walls 94 (FIG. 16). And, finally, as shown in FIG. 17, at wrapping station 90, sheet 6 is folded about the longitudinal edges 96 of a second major lateral wall 93*b* onto minor lateral walls 94 to complete tubular wrapping 91 with open end 92 at a second end 95*b*. The open end 92 of tubular wrapping 91 comprises two major flaps 99 at major transverse edges 97; and two minor flaps 100 at minor transverse edges 98.

As shown in FIG. 12, at wrapping station 89, wrapping wheel 84 comprises a movable folder 101, which comprises two folding members (only one shown in FIG. 12) on opposite sides of tubular spindle 85, and moves back and forth circumferentially to fold sheet 6 about the longitudinal edges 96 of first major lateral wall 93*a* (FIG. 15). At wrapping station 90, wrapping wheel 84 comprises a movable folder 102, which comprises two folding members (only one shown in FIG. 12) on opposite sides of tubular spindle 85, and moves back and forth radially to fold sheet 6 about the minor transverse edges 98 of first end 95*a* (FIG. 16). And, finally, at wrapping station 90 and downstream from movable folder 102 in its rotation direction, wrapping wheel 84 comprises a fixed folder 103, which has two folding members (only one shown in FIG. 12) on opposite sides of tubular spindle 85, and folds sheet 6 about the longitudinal edges 96 of second major lateral wall 93*b* (FIG. 13) as step rotation of wrapping wheel 84 moves tubular spindle 85 forward.

In other words, at feed station 86, sheet 6 is folded into a U about tubular spindle 85 to define open end 92, and two lateral portions, each having two opposite, facing wings projecting from tubular spindle 85 (FIG. 14); at wrapping station 89, at least a first wing of each lateral portion of sheet 6 is folded onto tubular spindle 85 (FIG. 15) before folding the end flap of the closed end onto tubular spindle 85 at wrapping station 90 (FIG. 16); at wrapping station 90, a second wing of sheet 6 is folded onto tubular spindle 85 to overlap the already folded first wing (FIG. 17); and, at a sealing station 104, the overlapping portions of the wings of each lateral portion of sheet 6 are heat sealed permanently to stabilize tubular wrapping 91.

Downstream from wrapping station 90 in its rotation direction, wrapping wheel 84 comprises sealing station 104, which comprises two sealing devices 105 (only one shown in FIG. 12) located on opposite sides of tubular spindle 85 to heat seal the superimposed portions of sheet 6 on minor lateral walls 94 of tubular spindle 85 and stabilize tubular wrapping 91.

Downstream from sealing station 104 in its rotation direction, wrapping wheel 84 comprises a control station 106 where an optical control device (not shown) examines each tubular wrapping 91 to ensure it is up to standard. Downstream from control station 106 in its rotation direction, wrapping wheel 84 comprises a reject station 107 in turn comprising a pneumatic or mechanical reject device (not shown) controlled by the optical control device at control station 106 to expel any flawed tubular wrappings 91 (i.e. not up to standard) off tubular spindles 85.

Finally, downstream from reject station 107 in the rotation direction of wrapping wheel 84, a transfer station 108 is located at the point of tangency between wrapping wheel 84 and a follow-up wrapping wheel 109, which is located alongside wrapping wheel 84, rotates in steps (anticlockwise in FIG. 12) about a horizontal axis of rotation parallel to the axis of rotation of wrapping wheel 84, and supports a number of peripheral pockets 110, each for housing a group 2 of cigarettes. At transfer station 108, each tubular wrapping 91 is removed axially off respective tubular spindle 85 of wrapping wheel 84, and is inserted into a pocket 110 of wrapping wheel 109. More specifically, each wrapping 91 is inserted into a pocket 110 of wrapping wheel 109 with open end 92 of tubular wrapping 91 facing outwards of pocket 110.

In a preferred embodiment, lateral walls 93 and 94 of each tubular spindle 85 have through holes connectable to a vacuum source to generate suction. Suction through lateral walls 93 and 94 of each tubular spindle 85 is activated at feed station 86, once sheet 6 is folded into a U, and is deactivated at transfer station 108 to permit transfer of tubular wrapping 91 from tubular spindle 85 to a pocket 110 of wrapping wheel 109. The purpose of the suction through lateral walls 93 and 94 of each tubular spindle 85 is to grip sheet 6 onto lateral walls 93 and 94 of tubular spindle 85 and prevent slippage of sheet 6 with respect to tubular spindle 85.

To transfer each tubular wrapping 91 from tubular spindle 85 of wrapping wheel 84 to a pocket 110 of wrapping wheel 109, transfer station 108 has a pusher 111 housed inside wrapping wheel 84 and movable back and forth radially into tubular spindle 85, and therefore into tubular wrapping 91 through the open end 92 of tubular wrapping 91, up to the closed end 112 of tubular wrapping 91. On reaching the closed end 112 of wrapping 91, pusher 111 continues moving outwards to push tubular wrapping 91 off tubular spindle 85 and into pocket 110 of wrapping wheel 109. Transfer station 108 preferably also has a lead-in device 113 located at the centre of wrapping wheel 109, and which moves back and forth radially in the insertion direction of tubular wrappings 91 inside pockets 110, and cooperates with pusher 111 when transferring each tubular wrapping 91 to a pocket 110. More specifically, lead-in device 113 on one side, and pusher 111 on the other side, grip the closed end 112 of tubular wrapping 91 to clamp and prevent lateral slip of tubular wrapping 91 during transfer. In other words, lead-in device 113 moves through pocket 110 towards tubular wrapping 91, until it touches the closed end 112 of tubular wrapping 91; and at the same time, pusher 111 begins pressing against the closed end 112 of tubular wrapping 91, on the opposite side to lead-in device 113, so as to grip tubular wrapping 91 together with lead-in device 113. At this point, pusher 111 and lead-in device 113 move together to the bottom of pocket 110 to ease tubular wrapping 91, gripped between them at all times, into pocket 110. To effectively grip tubular wrapping 91 and compensate for any construction tolerances and slack due to wear, lead-in device 113 and/or pusher 111 have/has an elastic member which is compressed elastically when gripping tubular wrapping 91.

In a preferred embodiment, suction is activated through lead-in device 113 through holes (not shown) connected to a vacuum source, so lead-in device 113 also exerts pull, to draw tubular wrapping 91 into pocket 110, which is added to the thrust exerted on tubular wrapping 91 by pusher 111.

Downstream from transfer station 108 in its rotation direction, wrapping wheel 109 comprises a control station 114 where an optical control device (not shown) examines each tubular wrapping 91 to ensure it is up to standard. Downstream from control station 114 in its rotation direction, wrapping wheel 109 comprises a reject station 115 in turn comprising a pneumatic or mechanical reject device (not shown) controlled by the optical control device at control station 114 to expel any flawed tubular wrappings 91 (i.e. not up to standard) from pockets 110.

At a transfer station 116 downstream from reject station 115 in the rotation direction of wrapping wheel 109, each group 2, together with respective stiffener 7, is transferred to a pocket 110 of wrapping wheel 109 containing a tubular wrapping 91, and so inserted inside tubular wrapping 91 through open end 92. By way of example, each group 2, together with respective stiffener 7, is transferred to pocket 110 of wrapping wheel 109 by an input wheel identical to input wheel 14 in FIG. 5 or input wheel 44 in FIG. 8.

Transfer station 116 has a truncated-cone-shaped, rectangular-cross-section hopper 117, which is formed by the union of four elastic (i.e. elastically deformable) petals 118, is located between group 2 and the pocket 110 containing tubular wrapping 91, and through which group 2 is fed into tubular wrapping 91. Hopper 117 serves to constrict group 2 (together with stiffener 7 and within the elastic deformation limits of group 2) to temporarily reduce the cross section of group 2 and so facilitate insertion of group 2 inside tubular wrapping 91. That is, truncated-cone-shaped hopper 117 is located in front of the open end 92 of tubular wrapping 91, and group 2 is pushed by a pusher 119 through hopper 117 into tubular wrapping 91.

In one embodiment, hopper 117 is movable radially back and forth with respect to wrapping wheel 109, to insert the outlet of hopper 117 inside the open end 92 of tubular wrapping 91, prior to insertion of group 2 inside tubular wrapping 91, and to extract the outlet of hopper 117 from the open end 92 of tubular wrapping 91, once group 2 is inserted inside tubular wrapping 91.

At a wrapping station 120 downstream from transfer station 116 in the rotation direction of wrapping wheel 109, sheet 6 is folded to close the open end 92 of tubular wrapping 91 and so complete package 1. More specifically, wrapping station 120 comprises two movable lateral folders 121 (only one shown in FIG. 12) movable back and forth axially (i.e. parallel to the axis of rotation of wrapping wheel 109); a subsequent movable central folder 122 movable back and forth radially (i.e. perpendicular to the axis of rotation of wrapping wheel 109); and a subsequent fixed central folder 123. More specifically, when wrapping wheel 109 is stopped, movable lateral folders 121, followed by movable central folder 22, fold sheet 6; and, as wrapping wheel 109 moves forward one step, fixed central folder 123 folds sheet 6 once more to complete closing the open end 92 of tubular wrapping 91 and so complete package 1.

At a sealing station 124 downstream from wrapping station 120 in the rotation direction of wrapping wheel 109, the superimposed portions of sheet 6 at open end 92 (now closed) are heat sealed, to stabilize package 1, by a sealing device 125 connected to and movable back and forth to and from wrapping wheel 109.

Finally, at a transfer station 126 downstream from sealing station 124 in the rotation direction of wrapping wheel 109, package 1, containing group 2 and stiffener 7, is expelled from pocket 110 of wrapping wheel 109.

In the FIG. 12 embodiment of wrapping unit 12, group 2 plays no part in folding sheet 6 into a U, which is done entirely at feed station 86, long before group 2 is inserted at transfer station 116. As such, both ends of the cigarettes in group 2 undergo absolutely no mechanical stress when folding sheet 6, and both the filters and the plain ends of the cigarettes undergo no deformation. Moreover, by virtue of folder 87 cooperating with tubular spindle 85, sheet 6 is first folded between appropriately contoured metal (i.e. rigid, non-deformable) parts, thus producing decidedly sharp edges at extraction opening 3 of package 1, and an attractive square visible top portion of package 1.

The invention claimed is:

1. A method of producing a package containing a group of cigarettes and having a cigarette extraction opening; the method comprising the steps of:

providing a first wrapping wheel including a first pocket having an inner bottom wall and an outer opening opposite the inner bottom wall;

feeding, by means of a first inserter, a sheet of wrapping material having a cigarette extraction opening into the first pocket of the first wrapping wheel so that:

the sheet of wrapping material is folded into a U-shape inside the first pocket, the cigarette extraction opening of the U-folded sheet of wrapping material is arranged near the inner bottom wall of the first pocket, and the U-folded sheet of wrapping material provides two free flaps that are arranged on opposite sides of the first pocket and project outside the outer opening of the first pocket; and subsequently feeding the group of cigarettes into the first pocket containing the U-folded sheet of wrapping material.

2. A method as claimed in claim 1, further comprising:

lifting the two free flaps of the U-folded sheet of wrapping material projecting from the first pocket; and folding the to free flaps one on top of the other, onto the group of cigarettes so as to form a tubular sheet of wrapping material.

3. A method as claimed in claim 2, further comprising using respective compressed-air jets on opposite sides of the first pocket to lift the two free flaps of the U-folded sheet of wrapping material projecting from the first pocket.

4. A method as claimed in claim 1, further comprising clamping against the first wrapping wheel the two free flaps of the U-folded sheet of wrapping material projecting from the first pocket, as the group of cigarettes is fed into the first pocket, and by means of a mechanical clamp which is pressed against the first wrapping wheel.

5. A method as claimed in claim 1, further comprising gripping by means of suction against the first wrapping wheel the two free flaps of the U-folded sheet of wrapping material projecting from the first pocket, as the group of cigarettes is fed into the first pocket.

6. A method as claimed in claim 1, further comprising folding two end flaps of the sheet of wrapping material squarely, as the sheet of wrapping material is fed into the first pocket, by means of two lateral folders on opposite sides of the first pocket.

7. A method as claimed in claim 6, wherein each lateral folder has a central recess facing inwards of the first pocket.

8. A method as claimed in claim 6, further comprising:

moving a movable portion of each lateral folder into an open position forming a recess facing inwards of the first pocket, as the group of cigarettes is inserted into the first pocket, and moving the movable portion of each lateral folder into a closed position substantially eliminating the recess facing inwards of the first pocket, once the group of cigarettes is inserted inside the first pocket.

9. A method as claimed in claim 1, further comprising pressing against the first wrapping wheel the two free flaps of the U-folded sheet of wrapping material projecting from the first pocket, once the sheet of wrapping material is inserted inside the first pocket, and by means of two lateral projections on the first inserter.

10. A method as claimed in claim 1, further comprising of gripping a central portion of the sheet of wrapping material between the first inserter and a corresponding lead-in device as the sheet of wrapping material is inserted into the first pocket.

11. A method as claimed in claim 1, further comprising applying a stiffener to the group of cigarettes, upstream from the first wrapping wheel.

12. A method as claimed in claim 11, further comprising:

feeding the stiffener into a second pocket of a second input wheel, so the stiffener is folded inside the second pocket;

subsequently feeding the group of cigarettes into the second pocket containing the folded stiffener; and transferring the group of cigarettes, together with the stiffener, from the second pocket of the second input wheel to the first pocket of the first wrapping wheel.

* * * * *